United States Patent [19]

Giardini

[11] 4,297,089

[45] Oct. 27, 1981

[54] ARCUATE TUBULAR PUMP

[75] Inventor: Dante S. Giardini, Dearborn Heights, Mich.

[73] Assignee: Ford Motor Company, Dearborn, Mich.

[21] Appl. No.: 973,278

[22] Filed: Dec. 26, 1978

[51] Int. Cl.[3] ..... F01B 19/00; F04B 45/06

[52] U.S. Cl. ..... 417/437; 92/13.2; 92/90

[58] Field of Search ..... 417/437; 92/13.2; 123/139 R

[56] References Cited

U.S. PATENT DOCUMENTS

| | | | |
|---|---|---|---|
| 1,694,801 | 12/1928 | Stokes | 123/180 |
| 1,973,180 | 9/1934 | Scott | 417/435 |
| 2,254,539 | 9/1941 | Mattox | 92/13.2 |
| 2,428,912 | 10/1947 | Hulsberg | 92/90 |
| 2,874,640 | 2/1959 | Vickers | 123/139 |
| 3,403,631 | 10/1968 | Tangeman | 417/475 |
| 3,489,097 | 1/1970 | Gemeinhardt | 92/13.2 |
| 3,684,408 | 8/1972 | Maclin | 417/477 |
| 3,723,030 | 3/1973 | Gelfand | 417/475 |

FOREIGN PATENT DOCUMENTS 1126190 10/1962 Fed. Rep. of Germany ..... 417/437

*Primary Examiner*—William L. Freeh

*Attorney, Agent, or Firm*—Steven L. Permut; Clifford L. Sadler

[57] ABSTRACT

A pump for a multi-cylinder piston engine has a plurality of C-shaped tubular members each with a hollow interior which has one end open to the hollow interior and sealably mounted to a housing with an inlet and outlet with a passage in communication with the inlet and outlet and the hollow interior. A cam shaft is rotatably mounted within the convex area defined by each C-shaped member which operably engages a pivotably mounted deflector panel which deflects a free end of the C-shaped member to change the volume of the hollow interior which forces fluid through the inlet into the passageway. The deflector member also is movable to disengage from the C-shaped member to decrease the volume of the hollow interior and force fluid through the outlet from the passageway.

15 Claims, 5 Drawing Figures

ARCUATE TUBULAR PUMP

BACKGROUND OF THE INVENTION

1. Field of the Invention

This invention relates to flexible resilient arcuate tubular member with a hollow interior which is in communication with valved inlets and outlets. The tubular member is flexed to change the volume of the hollow interior to pump fluid from the inlet to the outlet and more particularly to pump fuel to a fuel-injected internal combustion engine.

2. Description of the Prior Art

The most common type of fuel pump for an internal combustion engine is either a diaphragm pump or a pump which has a piston which is mounted within a cylinder for reciprocal movement.

Peristaltic pumps using tubes made from rubber or other synthetic elastomer which are filled with fluid and then pressed in a sweeping motion from the inlet to the outlet to force the fluid within the tube to the outlet have been used in other fields. Three peristaltic pumps are disclosed in U.S. Pat. Nos. 3,403,631 to Tangeman on Oct. 1, 1968; 3,684,408 issued to Maclin on Aug. 15, 1972; and 3,732,030 issued to Gelfand on Mar. 27, 1973.

Bourdon pressure tubes have been used as a pressure measuring device on automobiles. U.S. Pat. No. 1,694,801 issued to Stokes on Dec. 11, 1928 discloses a Bourdon tube which expands under pressure of heated air therein to partially close a valve which controls the flow of gasoline.

Federal Republic of Germany Pat. No. DBP 1126190 issued on Oct. 11, 1962 discloses a cam-driven hollow tubular leaf spring with a circular cross-section used as a pump.

SUMMARY OF THE DISCLOSURE

According to the invention, a long-lasting pump has a flexible arcuate member which has a hollow interior therein. A camming means is rotatably mounted adjacent the flexible arcuate member to repeatedly flex the arcuate member to expel from its outlet a plurality of discrete pulsed amounts of fluid. The arcuate member in cross-section has an eliptical-like shape with an oval shaped hollow interior to minimize the stress exerted therein while being flexed and to facilitate change of volume of the hollow interior due to its change of shape.

In one embodiment, a plurality of C-shaped tubular members each with a hollow interior are anchored at one end thereof to a housing member. The housing member has passageways therethrough. Each passageway has an inlet and outlet. Each passageway is in communication with a hollow interior of a respective C-shaped tubular members through the anchored ends thereof. A one-way check valve is operably connected to each inlet for allowing noncompressible fuel to pass through each inlet into each passageway and a second check valve is operably connected to each outlet to allow the fuel to pass through each outlet out of each passageway and into an internal combustion engine.

BRIEF DESCRIPTION OF THE DRAWINGS

The invention now will be described with reference to the accompanying drawings in which.

DETAILED DESCRIPTION OF THE PRESENTLY PREFERRED EMBODIMENT

Figure 1:
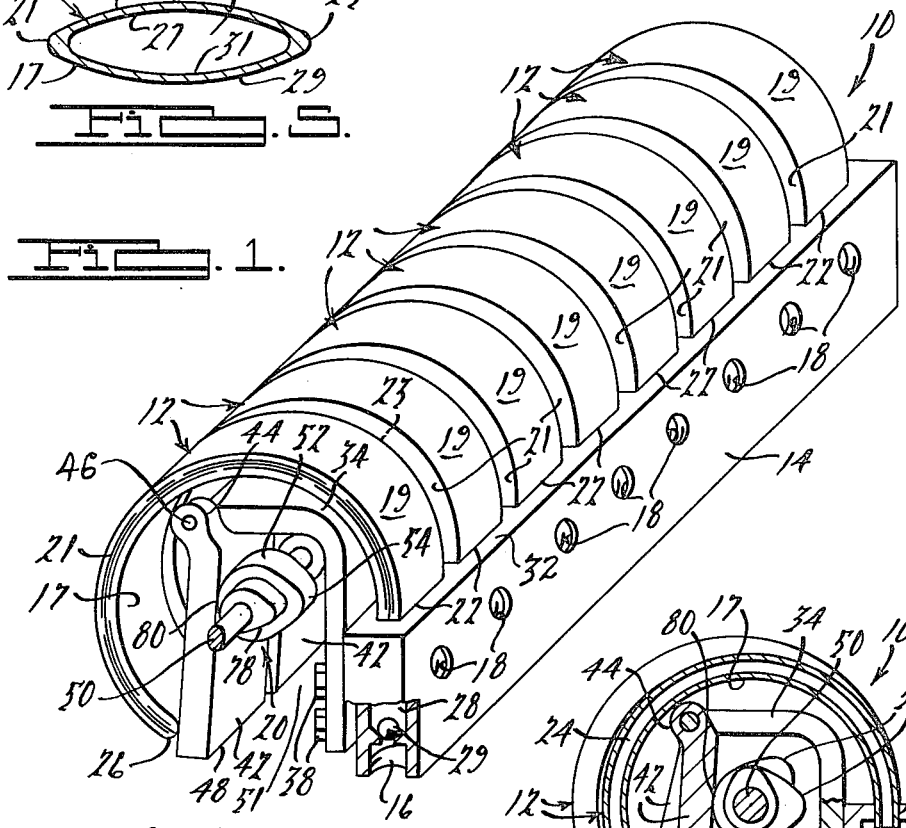
FIG. 1 is a perspective view of a presently preferred embodiment of the invention.

As shown in FIG. 1, a pump 10 has a series of C-shaped tubular members 12 attached to a housing 14 which has a series of passageways 15, inlets 16, and outlets 18 and which passes fuel from the inlet 16 through the passageway 15 and past the outlet 18 by operation of a cam system which flexes the C-shaped tubular members 12.

Figure 5:
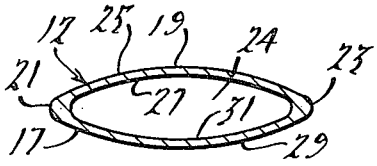
FIG. 5 is a cross-sectional view of the C-shaped tubular member taken along line V—V in FIG. 4.
Figure 3:
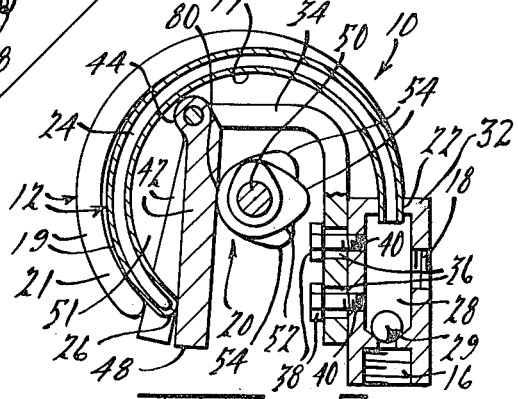
FIG. 3 is a side elevational and partially segmented view of the embodiment shown in FIG. 1 showing a C-shaped tubular member in a neutral position.

As shown in FIGS. 1, 3, and 5, each C-shaped tubular member has an inner wall 17 and outer wall 19 arced about a common center of radius. Wall 19 has a convex outer surface 25 and concave inner surface 27. Wall 17 likewise has a convex outer surface 29 and concave inner surface 31. Wall 19 has convex outer surface 25 curved away from the center of radius and wall 17 has convex surface 29 curved toward the center of radius such that walls 19 and 17 bulge away from each other near their central axes. The cross-section shape of member 12 as shown in FIG. 5 resembles an ellipse. Front edge 21 and rear edge 23 connect the inner wall 17 and outer wall 19. The maximum distance between inner wall 17 and outer wall 19 is substantially less than the distance between front edge 21 and rear edge 23 to provide for a shape with substantially higher rigidity in the axial direction than the radial direction. Walls 17 and 19 are integrally formed at closed end 26. Each tubular member 12 is manufactured from a metal or metal composite which is sufficiently rigid to prevent the walls 17 and 19 from collapsing but sufficiently flexible to allow member 12 to radially flex within an elastic limit about the radial center.

Figure 4:
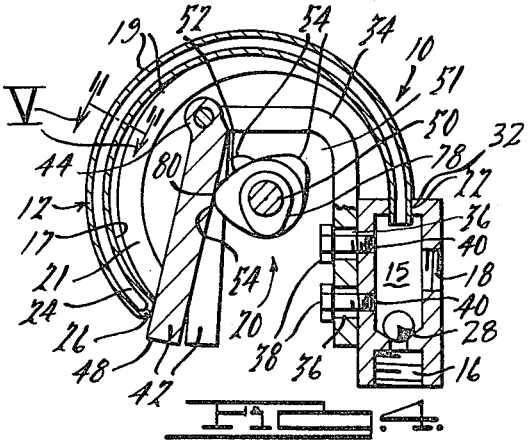
FIG. 4 shows the C-shaped tubular member in an outwardly flexed position.

The inner surfaces 27 and 31 of walls 17 and 19 define a hollow interior 24 with an oval shaped cross-section. The volume of hollow interior 24 is dependent upon the overall radius of the arc which is defined by the C-shaped member. Hollow interior 24 is completely filled with noncompressible fuel. The radius adjusted by flexure of the closed end 26 by the cam system 20. Each C-shaped tubular member 12 as shown in FIGS. 3 and 4 has an anchored open end 22 rigidly connected to the housing 14.

Figure 2:
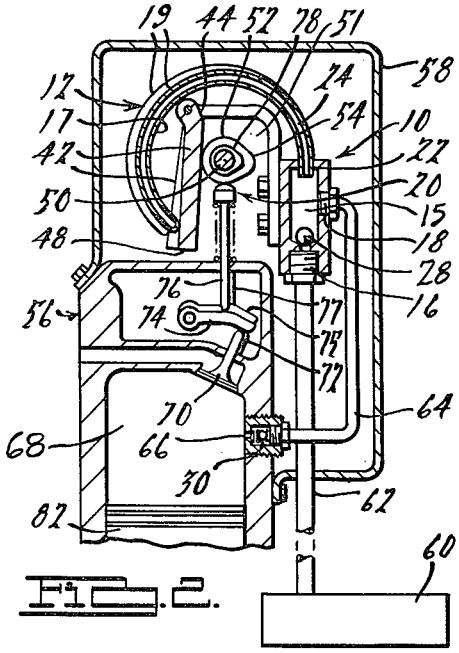
FIG. 2 is a side elevational and partially schematic view of the embodiment shown in FIG. 1 used as a fuel pump in a fuel injected internal combustion engine.

Each passageway 15 is in communication with one inlet 16 and one outlet 18 and also in fluid communication with the hollow interior 24 of one member 12 through the anchored open end 22. A check valve 28 is operably mounted in each inlet 16 and another check valve 30 is operably mounted to each outlet 18 as shown in FIG. 2.

The C-shaped tubular members 12 are aligned such that the anchored and open ends 22 all are attached to the top 32 of housing 14. The closed ends 26 are also aligned horizontally. Each of the eight C-shaped tubular members 12 are identical with the hollow interiors 24 of each C-shaped member 12 being the same initial size.

The cam system 20 includes a L-shaped frame 34 with depending deflector panels 42 and a rotatable cam shaft 50. The L-shaped frame 34 has slots 36 therethrough which receive bolts 38 which threadably engage apertures 40 in housing 14.

Each deflector panel 42 has a pair of tabs 44 which engage pin 46 for pivotably mounting the deflector panel 42 onto frame 34. Each deflector panel 42 is independently pivotable with respect to the frame 34. Each deflector panel 42 is rigid. Each panel 42 depends downwardly from the frame 34 to abut a respective closed end 26 of the tubular member 12. Each deflector panel 42 abuts only one C-shaped member 12.

Cam shaft 50 has its longitudinal axis aligned with the radial centers of each C-shaped tubular member 12. Cam shaft 50 is vertically spaced between tabs 44 and the bottom 48 of the deflector panels 42. The cam shaft 50 extends through the generally convex shaped areas 51 bounded by the C-shaped members 12. Cam shaft 40 has a set of cams 52. Each cam 52 has one lobe section 54. Each cam 52 is positioned to engage one deflector panel 42. The lobe sections 54 of the respective cams 52, as more clearly shown in FIGS. 3 and 4, are circumferentially spaced about the cam shaft 50 such that the lobe sections 54 of the cams 52 abut a respective deflector panel 42 in a predetermined and timed sequence as the cam shaft 50 rotates about its longitudinal axis in a clockwise direction as viewed in the FIGS. 1–4.

Referring now to FIG. 2, the pump 10 is mounted within cylinder head 58 of piston engine 56. Inlet 16 is in fluid communication with a fuel tank 60 through conduit 62 connected to each inlet 16. Each outlet 18 has conduit 64 leading and connected to a respective injector nozzle 66 which protrudes into a respective cylinder 68 of piston engine 56. Check valve 30 is mounted adjacent the nozzle 66. Air intake valve 70 and exhaust valve 72 are operated in conventional fashion through rocker arms 74 and 75 driven by tappets 76 and 77 which are run from cam shaft 50. A second set of cams 78 on cam shaft 50 operates tappets 76 and 77. Each cams 78 is smaller than cam 52 so that they do not engage deflector panels 42. The cams 78 can be interposed between the cams 52 such that the length of cam shaft 50 can be minimized.

OPERATION

The operation of the arcuate tubular pump 10 will now be described. Fuel is in conduit 62 in communication with inlet 16. Cam shaft 50 rotates to operate the pump 10 such that the cam surface 52 maintains minimal contact with deflector panel 42 at point 80 as shown in FIG. 3.

As the cam shaft 50 rotates, lobe section 54 engages deflector panel 42 to pivotably deflect it to the left as shown in FIG. 4 which causes closed end 26 to flex to the left outwardly and away from anchored end 22. The flexure of member 12 is predetermined not to exceed its elastic limit to prolong the life of the tubular member 12. The flexure of closed end 26 away from anchored end 22 causes the volume of hollow interior 24 to increase. The increase in volume is due to flexing of the inner surfaces 27 and 31 and changing their shape to give the hollow interior 24 a cross-sectional shape which is more circular and greater in area than the initial oval cross-sectional shape. In addition, the arcuate shape of C-shaped member 12 increases its radius due to the flexure thereof. Fuel is drawn in from conduit 60 through inlet 16 into passageway 15.

As lobe section 54 further rotates to disengage from the deflector panel 42, the deflector panel 42 swings back to its vertical position as indicated in FIG. 3 by its own weight and also by its spring-like biasing force of the C-shaped tubular member 12. During such motion, the hollow interior 24 reverts back to its initial smaller volume which forces the corresponding amount of fuel which is already within the hollow interior and passageway 15 past outlet 18, into conduit 64, past check valve 30, through the fuel injection nozzle 66, and into cylinder 68. The amounts fuel passing through the check valve 30 is precisely equal to the change in volume between the positions shown in FIG. 3 and the position shown in FIG. 4.

The cam shaft 50 is also operably connected to the valves 70 and 72 and also the operation of the piston 82 such that fuel is injected at the appropriate time in the cycle of the piston stroke. Since in a multi-cylinder piston engine, it is conventional to have the pistons firing in a timed sequence, the different lobe sections 54 are circumferentially spaced such that each C-shaped tubular member 12 operates in a different predetermined phase in relation with the other C-shaped tubular member 12.

If it is desired to change the amount of fuel per stroke entering into the piston, this can easily be done by loosening bolts 38 and moving the L-shaped frame 34 up or down with respect to housing 14 and retightening the bolts 36. When the L frame is moved downwardly, the cam shaft lobe section 54 abuts the deflector panel closer to the pivot axis of the deflector panel 42 which causes the deflector panel 42 to pivot through a greater degree which in turn flexes the closed ends 26 further outwardly and increasing the radius of the C-shaped tubular member to a greater degree which in turn increases the volume change of the hollow interiors 24. Again, the flexure of member 12 does not exceed the elastic limit which would permanently bend the member 12. Upon flexure of the C-shaped tubular member 12 back to its initial position as shown in FIG. 3, a greater amount of fuel is then pumped through the check valve 30 through the injection nozzle 66.

Conversely, if the L-shaped frame 34 is raised with respect to the housing 14, the lobe section 54 deflects the deflector panel 42 a lesser amount which in turn decreases the change of volume of the hollow interior between the flex position shown in FIG. 4 and the initial position as shown in FIG. 3 which causes less fuel to pass through the injection nozzle 54 per revolution of cam shaft 50.

In this fashion, a fuel pump has arcuate tubular members which are resilient and are repeatedly flexed between two positions to change the volume of its hollow interior to provide a predetermined precise amount of fuel to be pumped per cycle by said pump. Also an arcuate tubular member is provided with a long flex life due to minimization of stress in the tubular member during flexure.

Variations and modifications of the present invention are possible without departing from its scope and spirit as defined by the appended claims.

The embodiments of the invention in which an exclusive property or privilege is claimed are defined as follows:

1. A fuel pump for pumping noncompressible fuel to a multi-chambered internal combustion engine comprising:

a plurality of C-shaped tubular members being resiliently flexible in a generally radial direction;

each C-shaped tubular member being arced about a common line;

each C-shaped tubular member having a hollow interior;

a housing member anchoring one end of each C-shaped tubular members;

said housing member connected to said engine;

said housing member having a plurality of passageways;

each passageway having an inlet and outlet;

each of said hollow interiors of each respective C-shaped tubular member in fluid communication through said respective anchored end with said passageway between said inlet and outlet;

a one-way check valve means operably connected to said inlet for allowing fuel to pass through said inlet into said passageway;

camming means mounted in proximity to a free opposing end of each C-shaped tubular members and opposing said anchored ends movable to flex said free ends to change the volume of said hollow interiors a predetermined amount and movable to allow said C-shaped tubular members to resiliently flex back to return the volume of said hollow interiors to their initial amounts, whereby fuel passes into each hollow interior and is forced out from each hollow interior through said outlets upon a decrease in volume of said hollow interiors;

said camming means sequentially flexing and releasing each C-shaped tubular member in a pedetermined sequence corresponding to the firing sequence of the respective combustion chambers of said engine;

a cam shaft rotatably mounted about its longitudinal axis through a generally convex shaped area bordered by said C-shaped tubular members;

a plurality of cams on said cam shaft;

a plurality of deflector members pivotably connected about substantially aligned pivot axes to said C-shaped tubular members in proximity of said free end spaced away from said pivot axes;

said respective cams abutting said deflector member at a distance from where said deflectors abut said C-shaped members.

2. A pump as defined in claim 1 wherein said arcuate tubular member comprises:

an axially extending outer wall having a center of radius and a convex-shaped outer surface and concave inner surface;

an axially extending inner wall having a center of radius coaligned with said center of radius of said outer wall, a concave inner surface, and a convex-shaped outer surface;

said convex outer surface of said inner wall and outer surface of said outer wall convexly curved in opposing directions;

said free end connecting said inner wall with said outer wall;

a front edge integrally connecting said inner and outer walls;

a rear edge integrally connecting said inner and outer walls;

said inner surface of said inner wall, inner surface of said outer wall, said free end, and front and rear edges defining said hollow interior having an oval cross-sectional shape.

3. A fuel pump for pumping non-compressible fuel to a multi-chambered internal combustion engine comprising:

a plurality of C-shaped tubular members being resiliently flexible in a generally radial direction;

each C-shaped tubular member having a hollow interior;

a housing member anchoring one end of each C-shaped tubular members;

said housing member connected to said engine;

said housing member having a plurality of passageways;

each passageway having an inlet and outlet;

each of said hollow interiors of each respective C-shaped tubular member in fluid communication through said respective anchored end with said passageway between said inlet and outlet;

a one-way check valve means operably connected to said inlet for allowing fuel to pass through said inlet into said passageway;

a one-way check valve means operably connected to said outlet for allowing fuel to pass through said outlet of said passageway;

camming means mounted in proximity to a free opposing end of each C-shaped tubular members and opposing said anchored ends movable to flex said free ends to change the volume of said hollow interiors a predetermined amount and movable to allow said C-shaped tubular members to resiliently flex back to return the volume of said hollow interiors to their initial amounts, whereby fuel passes into each hollow interior and is forced out from each hollow interior through said outlets upon a decrease in volume of said hollow interiors;

said camming means sequentially flexing and releasing each C-shaped tubular member in a predetermined sequence corresponding to the firing sequence of the respective combustion chambers of said engine;

a cam shaft rotatably mounted about its longitudinal axis through a generally convex shaped area bordered by said C-shaped tubular members;

a plurality of cams on said cam shaft;

a plurality of deflector members pivotably connected about substantially aligned pivot axis to said C-shaped tubular members in proximity of said free end spaced away from said pivot axes;

said respective cams abutting said deflector member at a distance from where said deflectors abut said C-shaped members;

a support frame adjustably connected to said housing;

said deflector members are pivotally connected to said support frame with said pivot axes substantially aligned;

said cams abutting said deflector members between said pivot axes and where said deflector members abut said C-shaped tubular members;

adjusting means for adjustably connecting said support frame to said housing for adjusting the distance of said pivot axes of said deflector members to said longitudinal axis of said cam shaft such that the amount the cam surfaces deflect said deflector members the amount the C-shaped tubular member flexes, and the change of volume in the hollow interior are correspondingly adjustable;

said C-shaped tubular member is arced with a true radius with a defined center point at said intersection of two radii;

said center points being in substantial alignment with said longitudinal axis of said cam shaft;

said deflector members abut said free ends of said C-shaped tubular members such that deflection of said deflection members by said cams flexes said free ends outwardly from said anchored ends to increase said volumes of each hollow interior and disengagement of said cams from said deflector members allows said C-shaped tubular members to flex back to decrease the respective volumes of said hollow interiors to their initial amount.

4. A pump for noncompressible fluids comprising:

an arcuate tubular member being resiliently flexible between a first and second position having a hollow interior extending substantially the length of said member with an open end and a closed end;

said open end of said arcuate tubular member mounted to a housing;

said housing having an inlet and outlet and passageway therethrough with said passageway in fluid communication with the inlet, outlet, and said hollow interior through said open end of said arcuate tubular member;

a one-way check valve means operably connected in fluid communication with said inlet for allowing fluid to pass through the inlet into said hollow interior;

a one-way check valve means operably connected in fluid communication with said outlet for allowing fluid to pass through said outlet out of said hollow interior;

actuating means for flexing said arcuate member including:

a camshaft rotatably mounted on its longitudinal axis;

a cam on said camshaft;

a support frame adjustably connected to said housing member;

a deflector member pivotably mounted about a pivot axis from said support frame and extending toward said arcuate tubular member in proximity of said closed end;

said cam abutting said deflector member at a point spaced from said pivot axis of said deflector;

said deflector member constructed to abut said arcuate tubular member radially spaced with respect to said pivot axis from said support and from said position where said cam abuts said deflector member;

said actuating means constructed to displace said arcuate tubular member from said first position to said second position to change the volume of said hollow interior a predetermined amount and constructed to allow said arcuate tubular member to resiliently displace back to its unstressed first position whereby fluid passes into said arcuate tubular member from said inlet upon an increase in volume of said hollow interior and is forced out of said arcuate tubular member through said outlet upon a decrease in volume of said hollow interior; and adjusting means for adjustably connecting said support frame to said housing for adjusting the distance of said pivot axis to said longitudinal axis of said camshaft and the amount said cam deflects said deflector member whereby the change in volume of the hollow interior of said arcuate tubular member per revolution of said camshaft is adjustable a predetermined amount.

5. A pump as defined in claim 4 wherein said arcuate tubular member comprises:

an axially extending outer wall having a center of radius and a convex-shaped outer surface and concave inner surface;

an axially extending inner wall having a center of radius coaligned with said center of radius of said outer wall, a concave inner surface, and a convex-shaped outer surface;

said convex outer surface of said inner wall and outer surface of said outer wall convexly curved in opposing directions;

said closed end connecting said inner wall with said outer wall;

a front edge integrally connecting said inner and outer walls;

a rear edge integrally connecting said inner and outer walls;

said inner surface of said inner wall, inner surface of said outer wall, said closed end, and front and rear edges defining said hollow interior having an oval cross-sectional shape.

6. A pump as defined in claim 4 wherein said adjusting means comprise:

threaded holes in a side of said housing;

slotted apertures through said support frame;

bolt means extending through said slotted apertures and engaging said threaded holes for adjustably fastening said support means to said housing.

7. A pump as defined in claim 6 further comprising:

said housing including:

a plurality of separate passageways;

each passageway having an inlet and outlet;

a plurality of said arcuate tubular members having their respective open ends in communication with the respective said passageways;

said plurality of said arcuate tubular elements having their respective ends aligned to form two substantially parallel lines;

said camshaft having a plurality of axially spaced cams thereon;

said support frame pivotably mounting a plurality of deflector members;

each respective deflector member being positioned to be deflected by a respective cam;

each respective arcuate tubular member being axially located with respect to said longitudinal axis of said cam shaft to be radially flexed by a respective deflector member;

said cams on said cam shaft being circumferentially positioned about said cam shaft to pivotably deflect said deflector members in timed relationship such that said arcuate tubular members pump fluid through said respective outlets in timed sequence depending on the rotational speed of said cam shaft.

8. A pump as defined in claim 7 further comprising:

each arcuate tubular member shaped as an arc with a true center of radius;

said center of radius of each arcuate tubular member being substantially aligned along said longitudinal axis of said cam shaft;

said deflector members abutting the closed end of said arcuate tubular member such that deflection of said deflector member by said cam flexes said closed end of said arcuate tubular member radially outwardly from said center of radius to increase said volume of said hollow interior and disengagement of said cam from said deflector allows said closed end of said arcuate tubular member to resiliently flex back to its first position thereby decreasing said volume of said hollow interior.

9. A pump as defined in claim 8 wherein said arcuate tubular member comprises:

an axially extending outer wall having a center of radius and a convex-shaped outer surface and concave inner surface;

an axially extending inner wall having a center of radius coaligned with said center of radius of said outer wall, a concave inner surface, and a convex-shaped outer surface;

said convex outer surface of said inner wall and outer surface of said outer wall convexly curved in opposing directions;

said closed end connecting said inner wall with said outer wall;

a front edge integrally connecting said inner and outer walls;

a rear edge integrally connecting said inner and outer walls;

said inner surface of said inner wall, inner surface of said outer wall, said closed end, and front and rear edges defining said hollow interior having an oval cross-sectional shape.

10. A pump as defined in claim 4 further comprising:

said arcuate tubular member shaped as an arc with a true center of radius;

a cam shaft rotatably mounted about its longitudinal axis through a generally convex shaped area bordered by said arcuate tubular member;

a cam on said cam shaft;

a deflector member pivotably connected about a pivot axis to said housing and extending toward and abutting said arcuate tubular member in proximity of said closed end and spaced away from said pivot axis;

said cam surface abutting said deflector member between said pivot axis and the position where said deflector member abuts said arcuate tubular member such that deflection of said deflector member by said cam flexes said closed end of said arcuate tubular member outwardly to increase said volume of said hollow interior and disengagement of said deflector member by said cam allows said arcuate tubular member to resiliently flex back to its first position and decreasing said volume of said hollow interior.

11. A pump as defined in claim 10 wherein said arcuate tubular member comprises:

an axially extending outer wall having a center of radius and a convex-shaped outer surface and concave inner surface;

an axially extending inner wall having a center of radius coaligned with said center of radius of said outer wall, a concave inner surface, and a convex-shaped outer surface;

said convex outer surface of said inner wall and outer surface of said outer wall convexly curved in opposing directions;

said closed end connecting said inner wall with said outer wall;

a front edge integrally connecting said inner and outer walls;

a rear edge integrally connecting said inner and outer walls;

said inner surface of said inner wall, inner surface of said outer wall, said closed end, and front and rear edges defining said hollow interior having an oval cross-sectional shape.

12. A pump for noncompressible fluids comprising:

a C-shaped tubular member being resiliently flexible;

a C-shaped tubular member having a hollow interior extending substantially the length of said member;

a housing member anchoring one end of said C-shaped tubular member;

said housing member having a passageway therethrough with an inlet and outlet;

said hollow interior being in fluid communication through said anchored end with said passageway between said inlet and outlet;

a one-way check valve means operably connected to said inlet for allowing fluid to pass through the inlet into said passageway toward said outlet;

a one-way check valve means operably connected to said outlet for allowing fluid to pass through said outlet out of said passageway;

said C-shaped tubular member having a free end which can flex between a first and second position to vary its distance from said anchored end such that the volume of said hollow interior varies with the distance between said free end and anchored end;

a cam shaft rotatably mounted about its longitudinal axis;

a cam on said cam shaft;

a support frame adjustably connected to said housing member;

a deflector member pivotably mounted about a pivot axis on said support frame and extending axis on said support frame and extending toward said free end of said C-shaped tubular member;

said cam abutting said deflector member at a point spaced from said pivot axis of said deflector; said deflector abutting said C-shaped tubular member at a point differrently spaced from said pivot axis of said deflector;

said point of abuttment in proximity of said free end of said C-shaped tubular member;

said cam shaped to deflect said deflector member as said cam shaft rotates;

said deflector is positioned to flex said free end of said C-shaped tubular member to its first and second position to vary its distance from said anchored end to vary said volume of said hollow interior a predetermined amount whereby fluid passes into said C-shaped tubular member from said inlet upon an increase in volume of said hollow interior and is forced out of said C-shaped tubular member thereof said outlet upon a decrease in volume of said hollow interior;

adjusting means for adjustably mounting said support frame to said housing for moving said pivot axis radially with respect to said longitudinal axis of said cam shaft to vary its distance therefrom such that the cam surface deflects said deflector member a varying desired amount which in turn causes said deflector member to flex said free end of said C-shaped tubular member a varying desired amount which varies the predetermined change of volume of said hollow interior per revolution of said cam shaft.

13. A pump as defined in claim 12 wherein said adjusting means comprise:

threaded holes in side of said housing;

slotted apertures through said support frame;

bolt means extending through said slotted apertures and engaging said threaded holes for adjustably fastening said support means to said housing.

14. A pump as defined in claim 13 further comprising:

said housing including:

a plurality of separated passageways;

each passageway having an inlet and outlet;

a plurality of said arcuate tubular members having their respective anchored ends in communication with the respective said passageways;

said plurality of said C-shaped tubular elements having their respective ends aligned to form two substantially parallel lines;

said camshaft having a plurality of axially spaced cam surfaces thereon;

said support frame pivotably mounting a plurality of deflector members;

each respective deflector member being positioned to be deflected by a respective cam surface;

each respective C-shaped tubular member being axially located with respect to said longitudinal axis of said cam shaft to be radially flexed by a respective deflector member;

said cam surfaces on said cam shaft being angularly positioned on said cam shaft to pivotably deflect said deflector members in timed relationship such that said C-shaped tubular members pump fluid through said respective outlets in timed sequence depending on the rotation speed of said cam shaft.

15. A pump as defined in claim 14 further comprising:

each arcuate tubular member shaped as an arc with a true center of radius;

said center of radius of each arcuate tubular member being substantially aligned along said longitudinal axis of said cam shaft;

said deflector members abutting the free end of said arcuate tubular member such that deflection of said deflector member by said cam flexes said free end of said arcuate tubular member radially outwardly from said center of radius to increase said volume of said hollow interior and disengagement of said cam from said deflector allows said free end of said arcuate tubular member to resiliently flex back to its first position thereby decreasing said volume of said hollow interior.

* * * * *

UNITED STATES PATENT AND TRADEMARK OFFICE

CERTIFICATE OF CORRECTION

PATENT NO. : 4,297,089

DATED : October 27, 1981

INVENTOR(S) : Dante S. Giardini

It is certified that error appears in the above-identified patent and that said Letters Patent are hereby corrected as shown below:

IN THE FIGURES:

In Figure 1, numeral "28" should read -- 15 -- and numeral "29" should read -- 28 --. In addition, the cam 78 should be rotatably positioned such that the lobe of cam 78 is pointed upwardly as shown in Figure 3.

In Figure 2, the cam 78 should be rotatably positioned so that its lobe is pointed upwardly as shown in Figure 3. The tappet 76 should have its upper end abutting the cam 78.

In Figure 3, numeral "28" should read -- 15 -- and numeral "29" should read -- 28 --.

UNITED STATES PATENT AND TRADEMARK OFFICE

CERTIFICATE OF CORRECTION

PATENT NO. : 4,297,089

DATED : October 27, 1981

INVENTOR(S) : Dante S. Giardini

It is certified that error appears in the above-identified patent and that said Letters Patent are hereby corrected as shown below:

Column 1, line 6, before "flexible" insert -- a --;

line 8, after "with" insert -- a --; and line 8, "inlets and outlets" should read -- inlet and outlet --.

Column 2, line 50, after "radius" delete "adjusted" and insert -- of the arc is changed --.

Column 3, line 41, "cams" should read -- cam --;

line 41, "they do" should read -- it does --;

line 42, before "deflector" insert -- a --; and line 42, "panels" should read -- panel --.

Column 5, claim 1, lines 20-21, delete "opposing";

claim 1, lines 21-22, delete "and opposing" and insert -- opposite --;

claim 1, line 22, after the word "ends" insert -- , said camming means being --;

claim 1, line 42, after "members" insert -- and being positioned --; and claim 1, line 43, after "free end" insert -- that is --.

UNITED STATES PATENT AND TRADEMARK OFFICE

CERTIFICATE OF CORRECTION

PATENT NO. : 4,297,089

DATED : October 27, 1981

INVENTOR(S) : Dante S. Giardini

It is certified that error appears in the above-identified patent and that said Letters Patent are hereby corrected as shown below:

Column 6, claim 3, lines 24-25, delete "opposing";

claim 3, lines 25-26, delete "and opposing" and insert -- opposite --;

claim 3, line 26, after the word "ends" insert -- , said camming means being --;

claim 3, line 45, "axis" should read -- axes --;

claim 3, line 46, after "members" insert -- and being positioned --;

claim 3, line 47, after "free end" insert -- that is --; and claim 3, line 67, delete "said" and insert -- an --.

Column 8, claim 7, line 8, delete "elements" and insert -- members --.

Column 9, claim 9, line 5, after "wherein" insert -- each of --;

claim 9, line 6, "ibular member" should read -- tubular members --;

claim 10, line 30, "a cam" should read -- said cam --;

claim 10, line 33, delete "a cam on said cam shaft;";

UNITED STATES PATENT AND TRADEMARK OFFICE

CERTIFICATE OF CORRECTION

PATENT NO. : 4,297,089

DATED : October 27, 1981

INVENTOR(S) : Dante S. Giardini

It is certified that error appears in the above-identified patent and that said Letters Patent are hereby corrected as shown below:

claim 10, line 34, "a deflector" should read -- said deflector --;

claim 10, line 39, delete "surface"; and claim 11, lines 50-51, "arcu-e" should read -- arcuate --.

Column 10, claim 12, line 7, "a C-shaped" should read -- said C-shaped --;

claim 12, line 34, "extending axis on" should read -- extending from --;

claim 12, line 35, delete "and extending"; and claim 12, line 39, "abuttment" should read -- abutment --; after "abutment" insert -- between said deflector member and said C-shaped tubular member being --.

Column 11, claim 14, line 4, delete "separated" and insert -- separate --; and

UNITED STATES PATENT AND TRADEMARK OFFICE

CERTIFICATE OF CORRECTION

PATENT NO. : 4,297,089

DATED : October 27, 1981

INVENTOR(S) : Dante S. Giardini

It is certified that error appears in the above—identified patent and that said Letters Patent is hereby corrected as shown below:

Column 11, claim 14, line 15, delete "elements" and insert --members --.

Signed and Sealed this

Nineteenth Day of October 1982

[SEAL]

Attest:

GERALD J. MOSSINGHOFF

Attesting Officer

Commissioner of Patents and Trademarks